US005550462A

United States Patent [19]

Nakajima

[11] Patent Number: 5,550,462

[45] Date of Patent: Aug. 27, 1996

[54] REGULATED POWER SUPPLY CIRCUIT AND AN EMITTER FOLLOWER OUTPUT CURRENT LIMITING CIRCUIT

[75] Inventor: Akio Nakajima, Nara, Japan

[73] Assignee: Sharp Kabushiki Kaisha, Osaka, Japan

[21] Appl. No.: 266,182

[22] Filed: Jun. 27, 1994

[30] Foreign Application Priority Data

| | | | |
|---|---|---|---|
| Jun. 29, 1993 | [JP] | Japan | 5-186674 |
| Aug. 3, 1993 | [JP] | Japan | 5-192182 |
| Oct. 25, 1993 | [JP] | Japan | 5-266521 |

[51] Int. Cl.[6] ..... G05F 1/573

[52] U.S. Cl. ..... 323/277; 323/274; 323/279

[58] Field of Search ..... 323/273, 274, 323/275, 276, 277, 279, 281

[56] References Cited

U.S. PATENT DOCUMENTS

| | | | |
|---|---|---|---|
| 4,338,646 | 7/1982 | Davis et al. | 323/276 |
| 4,507,600 | 3/1985 | Okayama | 323/281 |
| 4,926,109 | 5/1990 | Koterasawa | 323/274 |
| 4,950,975 | 8/1990 | Fleischer | 323/277 |
| 5,491,401 | 2/1996 | Inoue et al. | 323/273 |

FOREIGN PATENT DOCUMENTS

| | | |
|---|---|---|
| 4-23332 | 2/1992 | Japan . |
| 4-98732 | 8/1992 | Japan . |

*Primary Examiner*—Peter S. Wong
*Assistant Examiner*—Jessica Han

[57] ABSTRACT

The present invention provides a regulated power supply circuit capable of stably limiting an output current even in a case where an output current detecting resistor having a low resistance is used. Emitter current of a series regulating transistor Q11 is detected by a current detecting resistor R8. The transistor Q11 is controlled by a transistor Q10 connected by a Darlington connection thereto. A current limiting circuit is composed of transistors Q12 and Q13, which are connected at their bases with one another. The collector of Q12 is connected to the base of Q10 so that the base current of Q10 is reduced at the time of limiting the output current. Emitters of Q12 and Q13 are connected to the resistor R8 by way of resistors R7 and R14, respectively.

5 Claims, 6 Drawing Sheets

REGULATED POWER SUPPLY CIRCUIT AND AN EMITTER FOLLOWER OUTPUT CURRENT LIMITING CIRCUIT

BACKGROUND OF THE INVENTION

1. Field of the Invention

The present invention relates to improvement of a series type regulated power supply circuit and an emitter follower type power amplifying circuit. The present invention, more detailedly, relates to a circuit for reducing power consumption of a regulated power supply circuit, a leak current breaking circuit for breaking leak current between input and output terminals in a regulated power supply circuit and a protecting circuit for an output transistor in an emitter follower type power amplifying circuit.

2. Description of the Prior Art

In order to prevent an output transistor from being broken down by over-load or short-circuit at the output terminal, a series type regulated power supply circuit as well as an emitter follower output type amplifying circuit, typically, includes an output current limiting circuit or a circuit for limiting power consumption of an output transistor. Now, with reference to drawings, the prior art and the problems thereof in the regulated power supply circuit and emitter follower output type amplifying circuit will be hereinafter described in that order.

FIG. 1 is a circuit diagram showing a prior art example of a three-terminal regulated power supply circuit and FIG. 2 is a circuit diagram showing a prior art example of a regulated power supply circuit of dual input voltage configuration that is modified from the three-terminal regulated power supply circuit.

The conventional three-terminal regulated power supply circuit includes, as shown in FIG. 1, a series regulating transistor Q11; a reference voltage generating circuit having transistors Q4 through Q8 for generating a reference voltage; an output voltage detecting circuit made up of output voltage dividing resistors R10 and R11; an error amplifying circuit having transistors Q1, Q2, Q3 and Q10; a drop voltage detecting circuit of a Zener diode DZ and a resistor R9; and a current limiting circuit of resistors R6, R7 and R8 and a transistor Q12.

In the three-terminal regulated power supply circuit having the above arrangement, the series regulating transistor regulates the voltage drop between the collector and emitter thereof to keep the output voltage constant independently of input voltage variations and load variations. The reference voltage generating circuit generates a reference voltage stable against change in operation temperature and supplies the voltage to the error amplifying circuit. The output voltage detecting circuit detects a voltage divided from the output voltage and supplies the voltage to the error amplifying circuit. The error amplifying circuit compares the divided voltage value of output voltage with the reference voltage value and regulates the series regulating transistor so as to cancel out variations in the output voltage. The drop voltage detecting circuit detects the voltage drop between the collector and emitter of the series regulating transistor to deliver the information to the current limiting circuit. The current limiting circuit detects the emitter current of the series regulating transistor and limits the base current of the series regulating transistor based on the detected result and the collector-emitter voltage drop.

As to the series regulating transistor Q11, the collector is connected to an input terminal 1, the emitter is connected to an output terminal 2 via the resistor R8 and the base is connected to the emitter of the transistor Q10. The output current detecting resistor R8 is disposed between the emitter of the series regulating transistor Q11 and the output terminal 2 to detect the emitter current of the series regulating transistor Q11 (≈ output current).

A series of resistors R6 and R7 is provided between the base and emitter of the series regulating transistor Q11. A junction S between the resistors R6 and R7 is connected to the base of the transistor Q12.

In the reference voltage generating circuit, the transistor Q4 has its base and collector connected therefore functions as a diode, and a reference voltage is generated between the collector of the transistor Q4 and a ground terminal 3. The thus generated reference voltage is supplied to the emitter of the transistor Q3 serving as an input stage of the error amplifying circuit.

An output voltage $V_O$ is divided by the resistors R10 and R11 in the output voltage detecting circuit so as to present an output-proportional voltage, $V_O$x {R11/(R10+R11)} at a junction point P between the resistors R10 and R11. The junction point P is connected to the base of the transistor Q3 as the input stage of the error amplifying circuit. The emitter of the transistor Q10 serving as an output stage of the error amplifier is connected to the base of the series regulating transistor Q11.

The Zener diode DZ as an component of the drop voltage detecting circuit is connected at its cathode to an input terminal 1 and the anode thereof is connected to one end of the resistor R9. The other end of the resistor R9 is connected to the base of the transistor Q12 in the current limiting circuit. The collector of the transistor Q12 is connected to both the base of the transistor Q10 and the collector of the transistor Q2. The transistor Q12 is constructed such as to limit the base current of the series regulating transistor Q11. That is, the resistor R12 is provided between the base and emitter of the series regulating transistor Q11. In this example, the transistors Q10 and Q11 form a Darlington connection.

The aforementioned current limiting circuit reduces the base current of the series regulating transistor Q11 when the transistor is short-circuited by load or over-loaded and therefore likely to deviate from its safe operating area. This reduction of the base current protects the series regulating transistor Q11 from being damaged or degraded.

In an operating state of the regulated power supply circuit in FIG. 1, with an input voltage $V_{IN}$, an output voltage $V_0$ and an output current $I_0$, the following relations (1) and (2) hold.

$$V_{IN}N=V_O+R_8\times I_O+V_{CBQ11} \quad (1)$$

$$V_{IN}=V_0+R_8\times I_O+V_{BBQ11}+V_{BBQ10}+V_{CBQ2}+V_{R2} \quad (2)$$

where $R_8$ denotes a resistance value of the resistor R8, $V_{CBQ2}$ and $V_{CBQ11}$ represent collector-emitter voltages of Q2 and Q11, respectively. $V_{BBQ11}$ and $V_{BBQ10}$ represent base-emitter voltages of Q11 and Q10, respectively. $V_{R2}$ indicates a voltage drop across the resistor R2.

In the above Eq.(2), if $R_8$=0.2Ω and output current $I_O$ =1A, it is necessary to set up the normal input voltage $V_{IN}$ to suffice a relation $V_{IN}\geqq V_O$+2.5V in order to allow the transistors Q11, Q10 and Q2 to operate within their respective active regions. Accordingly, the power consumption $P_{Q11}$ of the series regulating transistor Q11 is represented by the following expression (3).

$$P_{Q11}=(V_{IN}-V_O)\times I_0 \quad (3)$$

In Eq. (3), if $V_{IN}-V_O=2.5V$ and $I_O=1A$, $P_{Q11}$ becomes 2.5W or more (i.e., $P_{Q11}\geqq 2.5W$), so that it is impossible to make the power consumption of the series regulating transistor Q11 smaller than that level.

In contrast to this, it is known in the dual input voltage configuration that a point A in the circuit in FIG. 1 is cut off so that the circuitry on the left side relative to the point A is supplied by a separate power supply, bias voltage $V_B$ as shown in FIG. 2. Also in this case, the same relation between the input voltage $V_{IN}$ and the output voltage $V_O$ as in the above Eq.(1) holds, but Eq.(2) should be replaced by the following equation (4).

$$V_B=V_O+R_8\times I_O+V_{BBQ11}+V_{BBQ11}+V_{CBQ2}+V_{R2} \quad (4)$$

In this case, the bias voltage $V_B$, sufficing a relation $V_B\geqq V_O+2.5V$ that is equivalent to the previous relation for $V_{IN}$, supplies power to transistors Q2, Q10 and Q12 to be operated. In this configuration, suppose that, in the above Eq.(1), $R_8=0.2\Omega$, output current $I_O=1A$ and collector-emitter voltage $V_{CBQ11}$ of the series regulating transistor Q11 suffices $V_{CBQ11}\geqq 0.2V$, the following relation (5) holds:

$$V_{IN}-V_O\geqq 0.2\times 1+0.2=0.4V \quad (5)$$

Accordingly, from the Eq.(3), a power consumption $P_{Q11}$ by the series regulating transistor Q11 suffice the following relation (6):

$$V_{Q11}\geqq 0.4\times 1=0.4W \quad (6)$$

Therefore, it is possible for the configuration shown in FIG. 2 to reduce the power consumption as compared to the configuration shown in FIG. 1.

Meanwhile, in the regulated power supply circuits shown FIGS. 1 and 2, the current limiting circuit limits emitter current of the series regulating transistor Q11 when the drop voltage ($V_{IN}-V_O$) is likely to exceed a predetermined level or when output current $I_O$ ($I_0\approx$emitter current of Q11) is apt to exceed a predetermined level, whereby breakdowns of the series regulating transistor and load circuit will be protected.

Initially, in the drop voltage detecting circuit, the following relation (7) holds:

$$V_{in}-V_O=D_{DZ}+I_1\times R_9+V_{BBQ12}, \quad (7)$$

where $V_{IN}-V_O$ is a drop voltage between input and output terminals, $V_{DC}$ is a Zener voltage of the Zener diode DZ, $I_1$ is a current through the Zener diode DZ, and $V_{BBQ12}$ is a threshold voltage between the base and emitter of the transistor Q12.

As is apparent from Eq.(7), $I_1$ starts to flow when the drop voltage ($V_{IN-VO}$) exceeds $V_{DZ}+V_{BBQ12}$. This causes the transistor Q12 to become active, base current of the transistor Q10 reduces by the equivalent of collector current of the transistor Q12. As a result, emitter current of the series regulating transistor Q11 or output current $I_O$ lowers so that the power consumption of the series regulating transistor Q11 is suppressed.

Next, with regard to the output current limiting value defined by the output current limiting circuit, from the fact that the voltage drop across the resistor R8 due to output current $I_O$ plus the voltage to be applied across the resistor R7 by dividing the base-emitter voltage of the series regulating transistor Q11 by the resistors R6 and R7 is equal to the base-emitter voltage of the transistor Q12, the following equation (8) holds when a peak output current is designated by lop:

$$V_{BBQ12}=V_{BBQ11}\times\{R_7/(R_6+R_7)\}+I_{OP}+R_8 \quad (8)$$

where $V_{BBQ12}$, $V_{BBQ11}$ are base-emitter voltages for transistors Q12 and Q11, respectively, and $R_6$, $R_7$ and $R_8$ are resistance values for R6, R7 and R8, respectively.

For instance, assuming that $V_{BBQ12}=0.7V$, $V_{BBQ11}=0.7V$, $R_6=600\Omega$, $R_7=400\Omega$, and $R_8=0.2\Omega$, $I_{OP}$ becomes equal to $2.1A(I_{OF}=2.1A)$. That is, the peak value of the output current can be limited up to 2.1A, no output current in excess of this level arises, whereby the series regulating transistor Q11 may be protected from being broken down or deteriorated.

In the conventional regulated power supply circuit described heretofore, for the purpose of further reducing $V_{IN}-V_O$ value in which the circuit can be operated, it is necessary to lower the value of resistor R8. However, in order to lower the value of resistor R8 with peak output current $I_{OP}$ being kept constant, the ratio between resistance values of resistors R6 and R7 must be varied as could be understood from Eq.(8). In order to sharply reduce the value of the resistor R8, suppose that R8=0.05Ω, R6=150Ω, R7=850Ω, the following relation holds from Eq.(8):

$$0.7=0.7\times 850/(150+850)+I_{OP}\times 0.05 \quad (9)$$

Therefore, $I_{OP}=2.1(A)$.

In this case, if only the base-emitter voltage $V_{BBQ11}$ of the transistor Q11 is on and even if $I_O$ is small or near to zero, the base-emitter voltage $V_{BBQ12}=0.7\times 850/(1000)+0\approx 0.595V$ or the transistor Q12 goes into its operative state. A further elevation of the junction temperature will cause the transistor Q12 to be activated with a still lower output current $I_O$. In this way, the conventional over-current limiting circuit would became activated despite that the output current of the power supply falls in the normal range, thereby degrading the load change ratio Reg-L characteristic, and the like.

On the other hand, as to the regulated power supply circuit of dual power voltage type shown in FIG. 2 above, it is possible to cut off the emitter current of the transistor Q10 by making the bias voltage $V_B$ equal to 0V with the input voltage $V_{IN}$ being kept applied. Therefore, it is possible to turn the output voltage $V_O$ on and off by controlling $V_B$.

However, in the arrangement of the conventional regulated power supply circuit shown in FIG. 2, when the bias voltage $V_B$ is set equal to 0V, that is, even in a case where no current is supplied between the base and collector of the transistor Q10, a leak current due to the input voltage $V_{IN}$ flows from the input terminal 1 to the output terminal 2 by way of the Zener diode DZ, resistors R9, R7 and R8. Accordingly, even if the bias voltage was made equal to 0V in order to try to shut down voltage supply to the load, application of a greater input voltage than the Zener voltage $V_{DZ}$ to the input terminal 1 would generate an output voltage $V_O$ at the output terminal 2, causing a leak current to flow, defectively.

Next, a conventional example of an emitter follower output type amplifying circuit is shown in FIG. 3.

The conventional emitter follower output type amplifying circuit includes: as shown in FIG. 3, a differential amplifier consisting of transistors Q21 to Q24, resistors R21, R22 and a constant-current circuit IA; and an output circuit consisting of an output transistor Q25, transistors Q26, Q27, resistors R23, R24 and a constant-current circuit IB. Here, transistors Q26, Q27 and resistors R23, R24 constitute an output current limiting circuit. Reference numerals 21 and 22 respectively designate input terminals to which differential input signals are input. Reference numerals 23 and 24 designate an output terminal and a power input terminal to which a power voltage $V_{CC}$ is supplied.

The conventional emitter follower output type amplifying circuit as configurated above operates as follows. That is, the transistors Q21 and Q22, are both connected at their emitters to the common current source IA, and connected at their bases with input terminals 21 and 22, respectively, forming a differential amplifier. Input signals $V_1$ and $V_2$ are supplied to the input terminals 21 and 22, respectively and in response to the voltage difference between the input signals $V_1$ and $V_2$, collector voltage of the transistor Q22 varies. The collector of the transistor Q22 is connected to the base of the output transistor Q25, which in turn outputs an impedance-transformed output voltage $V_3$ from its emitter.

If the output terminal 23 that is connected to the emitter of the output transistor Q25 is connected to a low-impedance and therefore to be lowered in potential, so as to be short-circuited to the ground, the collector current $I_{25}$ flows through the output transistor Q25 $h_{PE}$-times as great as the base current $I_b$ through the same transistor $Q_{25}$. In the configuration in which the collector of the transistor Q25 is directly connected to the power supply $V_{CC}$, the current $I_{25}$ is unlimited when the aforementioned short-circuit is made, to causing a certain danger of breaking down the transistor Q25.

To deal with this, the conventional emitter follower output circuit includes a current limiting circuit composed of a transistors Q26, Q27, resistors R23, R24 and makes the circuit control the collector current through the transistor Q25.

In this conventional current limiting circuit, the resistor R23 is a resistor for detecting collector current ($I_{25}$) through the output transistor Q25, and the transistor that is biased by the resistor R24 is a transistor for limiting current. The transistor Q26 is for detecting current and the resistor R23 is connected between the base and emitter of the transistor Q26. This transistor Q26 is activated when the voltage drop across the resistor R23 exceeds a threshold of the base-emitter voltage thereof, and absorbs the bias current that flows through R24. This causes the base current through the transistor Q27 to decrease to thereby prevent the collector current of the transistor Q27 from increasing. Thus, the emitter current of the output transistor Q25 is limited.

A current limiting value $I_{25LIM}$ can be shown by the following expression (10), $$I_{25LIM} \approx V_{BBQ26}/R_{23} \tag{10}$$

where $V_{BBQ26}$ denotes the voltage between base and emitter of the transistor Q26 and $R_{23}$ indicates a resistance value of the resistor R23.

Nevertheless, in the thus constructed conventional emitter follower output current limiting circuit shown in FIG. 3 above, the current limiting circuit itself brings about a considerably large voltage drop, disadvantageously, so that it is impossible to raise the output voltage $V_3$.

More specifically, in the circuit configuration in FIG. 3, a high-level $V_{3H}$ of the output voltage $V_3$ is shown by an expression (11) as follows:

$$V_{3H} = V_{CC} - (V_{R24} + V_{BBQ26} + V_{BBQ27} + V_{CBQ25}) \tag{11}$$

where $V_{R24}$ is a voltage drop across the resistor R24, $V_{BBQ26}$, $V_{BBQ27}$ are base-emitter voltages of transistors Q26 and Q27, respectively, and $V_{CBQ25}$ is a collector-emitter voltage of the transistor Q25. Suppose that $V_{R24}$=0.2V, $V_{BBQ26=VBBQ27}$=0.7 V and $V_{CBQ25}$=0.2V, a maximum $V_{3Hmax}$ of the output voltage $V_3$ can be written as the following expression (12).

$$V_{3Hmax} = V_{CC} - 1.8V \tag{12}$$

That is, this configuration would suffer from a problem that it is impossible to raise the high-level output voltage $V_{3H}$ more than the this value.

SUMMARY OF THE INVENTION

Under consideration of the problems above, it is therefore a first object of the present invention to provide a regulated power supply circuit which can save the power consumption while it is possible to achieve both prevention of misoperation of the current limiting circuit due to temperature elevation and reduction in the resistance value of the output current detecting resistor.

A second object of the present invention is to provide a regulated power supply circuit wherein a leak current that would flow from the input terminal to the output terminal can be cut off when the bias voltage is OV so that the controllability by the bias voltage may be enhanced and wherein it is possible to eliminate the power loss that would be caused by a leak current when the regulated power supply circuit is off.

Further, a third object of the present invention is to provide an emitter follower output current limiting circuit in which a current limiting circuit itself has a reduced voltage drop so that the high-level voltage $V_{3H}$ may be increased still more.

In order to solve the problems above, the present invention is configurated as follows.

In accordance with a first aspect of the present invention, a regulated power supply circuit comprises: a series regulating transistor disposed between input and output terminals with the collector and emitter connected to the input and output terminals, respectively; a reference voltage generating circuit for generating a reference voltage based on a bias voltage that is separately input; an output voltage detecting circuit for detecting an output-proportional voltage that is proportional to an output terminal voltage; an error amplifying circuit for controlling the base current of the series regulating transistor on the basis of the detected output-proportional voltage and the reference voltage; a drop voltage detecting circuit for detecting a voltage between the input and output terminal; and a current limiting circuit for detecting the emitter current of the series regulating transistor and for limiting the base current of the series regulating transistor in response to the resultant detection of the emitter current and the resultant detection of the drop voltage, wherein the current limiting circuit includes a pair of transistors which are connected at their bases with one another and each of emitter of the pair transistor is connected to the output terminal through a respective resistor.

In accordance with a second aspect of the present invention, a regulated power supply circuit comprises: a series regulating transistor disposed between input and output terminals with the collector and emitter connected to the input and output terminals, respectively; a reference voltage generating circuit for generating a reference voltage based on a bias voltage that is separately input; an output voltage detecting circuit for detecting an output-proportional voltage that is proportional to an output terminal voltage; an error amplifying circuit for controlling the base current of the series regulating transistor on the basis of the detected output-proportional voltage and the reference voltage; a drop voltage detecting circuit for detecting a voltage between the input and output terminal; a current limiting circuit for detecting the emitter current of the series regulating transistor and for limiting the base current of the series regulating transistor in response to the resultant detection of the emitter current and the resultant detection of the drop voltage; and a breaker circuit which detects a voltage at the base of the series regulating transistor and which, when the resultant detection of the base voltage is not more than a reference setup level, shuts down leak current that flows from the input terminal into the drop voltage detecting circuit.

In accordance with a third aspect of the present invention, an emitter follower current limiting circuit comprises: an output transistor disposed in emitter follower arrangement; a driver transistor having an opposite conduction type to that of the output transistor and being connected at the collector thereof with the base of the output transistor; collector current detecting means inserted between the collector of the output transistor and a power supply for detecting the collector current of the output transistor; and a feed-back circuit for provide a feed back from the collector of the output transistor to the emitter of the driver transistor.

In the third configuration of the present invention, the emitter follower current limiting circuit can be constructed such that the feed-back circuit includes a transistor and a voltage between both terminals of the collector current detecting means is connected between the base and emitter of the transistor in the feed-back circuit while the collector of the same transistor is connected to the emitter of the driver transistor.

Further, in the third configuration of the present invention, it is possible to construct the feed-back circuit with a serially connected circuit of a diode and resistors.

In the configuration in accordance with the first aspect of the present invention described above, the base current of the series regulating transistor is controlled by the potential difference between the emitters of the pair of transistors in the current limiting circuit which are connected at their bases With one another, namely by the difference between base-emitter voltages of the pair transistors. By this arrangement, even though the detecting resistance for detecting the output current is made small, it is possible to avoid that misoperation of the transistor in the current limiting circuit which would occur in spite of a normal output current range due to temperature elevation and therefore it is possible for the current limiting circuit to operate only when excessive current flows. Further, the resistance value of the output current detecting resistor can be made small, it is possible to realize a regulated power supply circuit with less power consumption.

Further, in accordance with the second aspect of the present invention described above, when the bias voltage is greater than the predetermined level, the series regulating transistor operates on the basis of the reference voltage generating circuit and the error amplifying circuit, thereby regulating the output voltage to be delivered at the output terminal. On the other hand, when the bias voltage is not more than the predetermined level, the series regulating transistor goes into off-state and the breaker circuit functions. This breaker circuit can shut down the leak current that would flow from the input terminal to the drop voltage detecting circuit as well as the leak current that would flow into the load.

Moreover, in accordance with the third aspect of the invention, the output current from the emitter follower output circuit is detected on basis of a voltage drop across the current detecting resistance and a quantity in association with the detected voltage drop is fed back to the emitter of the driver transistor. By this configuration, it is possible to not only limit the current of the output transistor without using the current limiting transistor which used to be disposed in series with the output transistor, but also to provide an increased high-level output voltage as compared to that obtained in the prior art configuration.

BRIEF DESCRIPTION OF THE DRAWINGS

The aforementioned and other objects and features of the present invention will become apparent from novelties claimed in the claims and from the description to be read in conjunction with the accompanying drawings, in which:

DESCRIPTION OF THE PREFERRED EMBODIMENTS

Now, an embodiment of the present invention will hereinafter be described with reference to the accompanying drawings.

Figure 4:
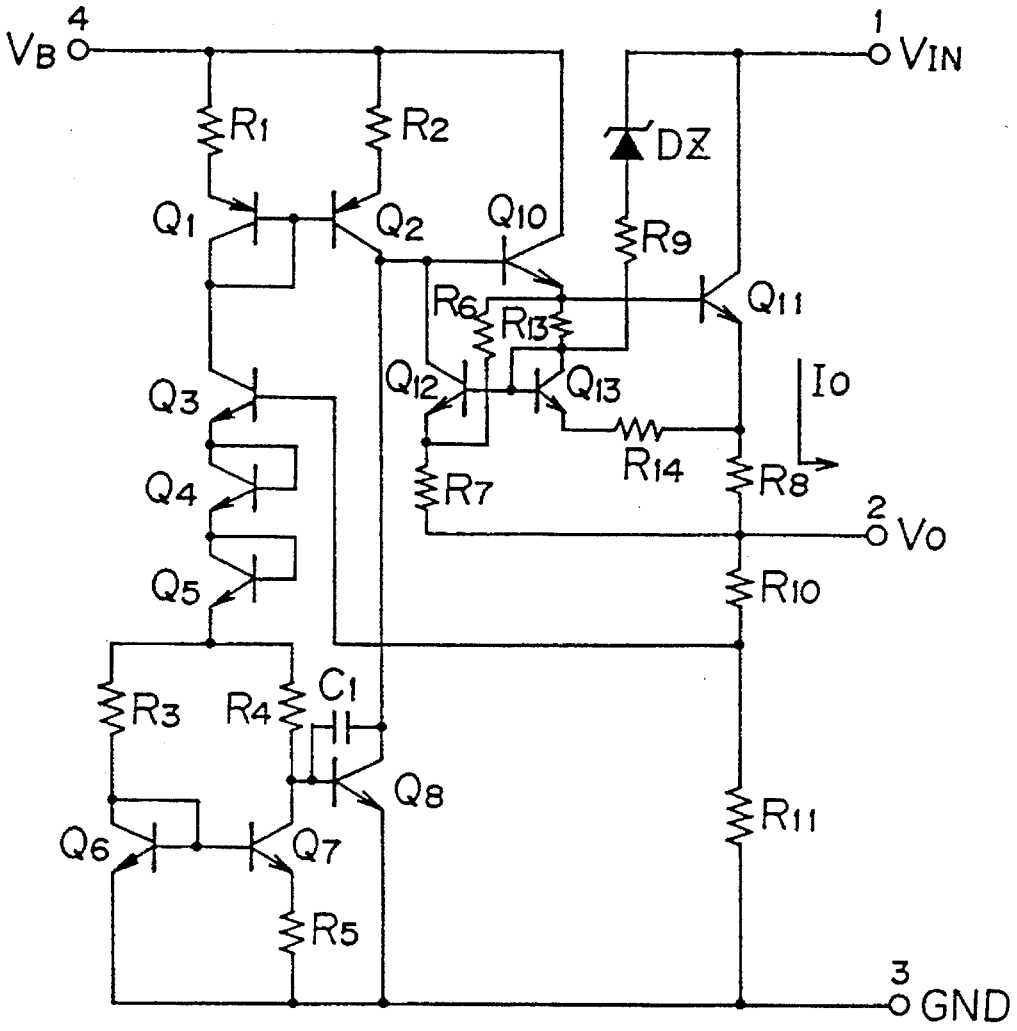
FIG. 4 is a circuit diagram showing a configuration of a regulated power supply circuit in accordance with a first embodiment of the present invention.

FIG. 4 is a circuit diagram showing a configuration of a first embodiment of a regulated power supply circuit or a voltage regulator in accordance with the present invention. Here, for description, the same parts or components with those in the prior art will be assigned with the same reference numerals.

The regulated power supply in accordance with the first embodiment of the present invention includes: a series regulating transistor Q11; a reference voltage generating circuit having transistors Q4 through Q8 for generating a reference voltage on the basis of a separately inputted bias voltage; an output voltage detecting circuit made up of dividing resistors R10 and R11; an error amplifying circuit having transistors Q1, Q2, Q3 and Q10; a drop voltage detecting circuit of a Zener diode DZ and a resistor R9; and a current limiting circuit of resistors R6, R7, R8, R13 and R14 and transistors Q12, Q13.

The transistors Q12 and Q13 are connected at their bases with one another and the base and collector of the transistor Q13 are connected together to one end of the resistor R13 as well as to one end of the resistor R9 of the drop voltage detecting circuit. The emitter of the transistor Q13 is connected by way of the resistor R14 to a junction between the emitter of the series regulating transistor Q11 and the current detecting resistor R8.

The emitter of the transistor Q12 is a junction S between resistors R6 and R7 which are connected in series between the base and emitter of the series regulating transistor Q11. The collector of the transistor Q12 is connected to the base of the transistor Q10 and the collector of the transistor Q2. In this arrangement, when the transistor Q12 is activated, an output current $I_O$ that flows through the series regulating transistor Q11 will be limited.

In the first embodiment of the regulated power supply circuit thus constructed, when a drop voltage ($V_{IN}$–$V_O$) between an input terminal 1 and an output terminal 2 is small or, in particular, smaller than the Zener voltage of the Zener diode DZ in the drop voltage detecting circuit, current flows through the resistor R13, transistor Q13, resistor R14 and resistor R8 as long as the output current falls in a normal use range. Accordingly, the following relation (13) holds:

$$V_{R7}>V_{R8}+V_{R14} \tag{13}$$

so that the transistor Q12 is in its off-state. Here, $V_{R7}$, $V_{R8}$ and $VR_{14}$ indicate voltage values across respective resistors.

As the output current further increases from the above state, $V_{R8}$ in the relation (13) becomes large. Then, the collector through transistor Q12 flows so as to suffice the following relation (14).

$$V_{BBQ12}+V_{R7}=V_{BBQ13}+V_{R8}+VR_{14} \tag{14}$$

Accordingly, the base current of the series regulating transistor Q11 is limited and consequently the output current is limited.

Thus, the base current of the series regulating transistor is limited by the base-emitter voltages of the transistors Q12 and Q13 so that, even if the detecting resistance $R_8$ for detecting the output current $I_0$ is taken low, the transistor Q12 may be kept in its off-state as long as the output current falls within the normal use range by properly adjusting resistance ratio between the resistors R6 and R7, and the current limiting circuit operates only when an excessive current flows. In this configuration, the power consumption $P_{O11}$ of the series regulating transistor Q11 in this state may be derived from Eq.(3) as the following expression (15).

$$\begin{aligned} P_{Q11} &= (V_{IN}-V_O)\times I_O \\ &= (R_8\times I_O+V_{CEQ11})\times I_O \end{aligned} \tag{15}$$

In the circuit configuration of the present invention, with the resistance value $R_8$ of the resistor R8 as low as about 0.05Ω, no problem occurs that would occur in the conventional configuration.

In this way, even in the case where the resistance of the detecting resistor R8 for detecting the output current of the series regulating transistor Q11 is set low, it is possible to avoid the situation in which, in spite of the normal output current, the transistor Q12 for regulating the base current of the series regulating transistor Q11 turns on, and it is possible to allow the current limiting circuit to operate only when an over-current flows.

As a result, it is possible to realize a low-consumption, regulated power supply circuit in which the voltage drop of the regulated power supply circuit itself is reduced by lowering the output current detecting resistance.

In this connection, the drop voltage detecting circuit allows current to flow from the input terminal 1 by way of the Zener diode DZ, resistor R9, transistor Q13, resistor R14 and resistor R8 to the output terminal 2 when the drop voltage between the input terminal 1 and output terminal 2 ($V_{IN}$–$V_O$) is greater than the Zener voltage of the Zener diode DZ. Accordingly, the base potential of the transistor Q12 is raised by the voltage drop across the resistor R14. As a result, when the voltage drop across the resistor R8 is small, in other words, when the output current $I_O$ is low, the condition of Eq.(14) is satisfied so that the current limiting circuit operates as a power consumption inhibiting circuit.

Figure 5:
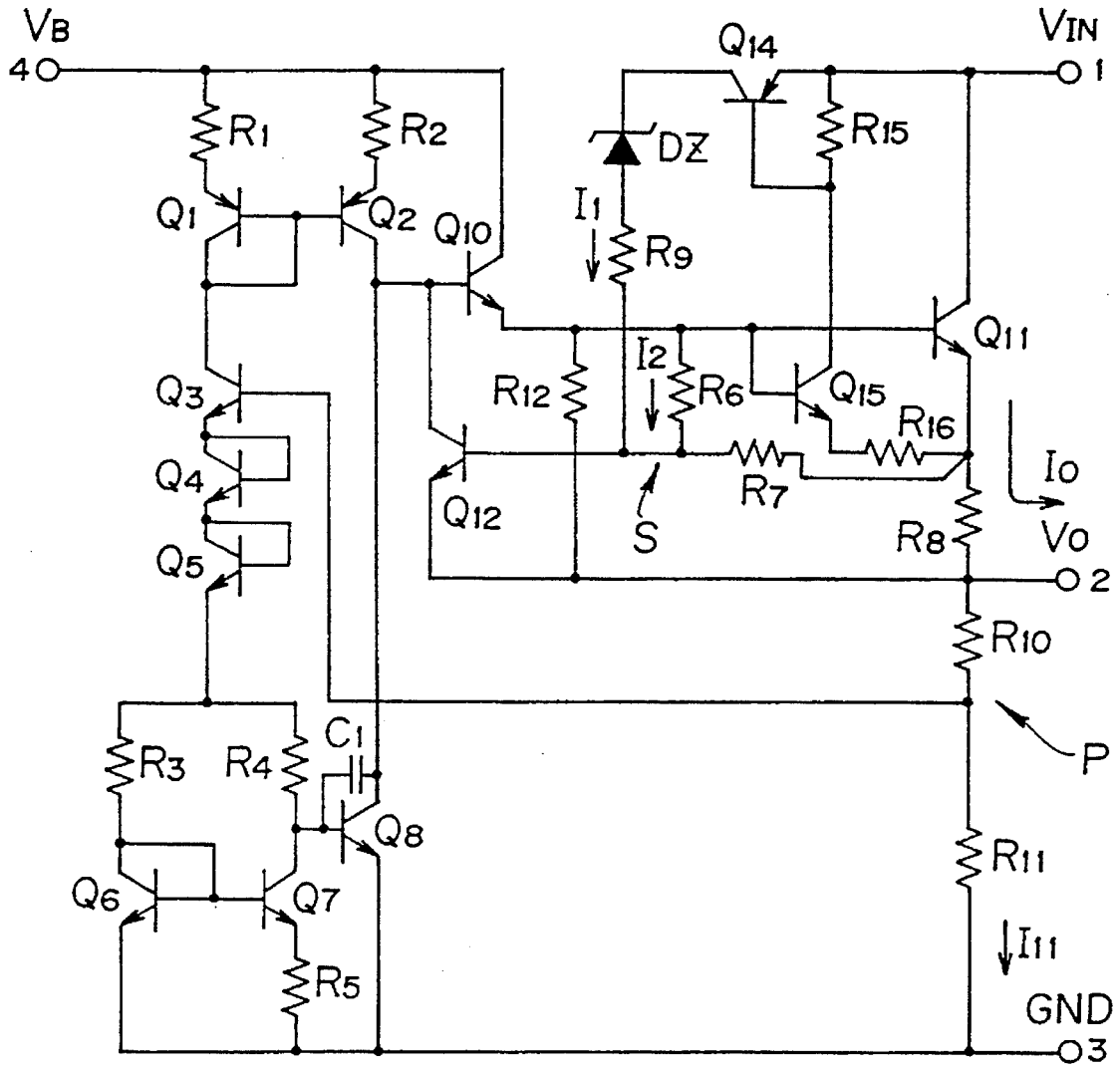
FIG. 5 is a circuit diagram showing a configuration of a regulated power supply circuit in accordance with a second embodiment of the present invention.

FIG. 5 is a circuit diagram showing a configuration of a second embodiment of a regulated power supply circuit in accordance with the present invention. Here, for description, the same parts or components with those in the prior art will be assigned with the same reference numerals.

The regulated power supply in accordance with the second embodiment of the present invention includes: a series regulating transistor Q11; a reference voltage generating circuit having transistors Q4 through Q8 for generating a reference voltage on the basis of a separately inputted bias voltage;. an output voltage detecting circuit made up of dividing resistors R10 and R11; an error amplifying circuit having transistors Q1, Q2, Q3 and Q10; a drop voltage detecting circuit of a Zener diode DZ and a resistor R9; a current limiting circuit of resistors R6, R7, R8 and R12 and transistor Q12; and a breaker circuit made up of a transistor Q14 for switching the drop voltage detecting circuit and a transistor Q15 for switching the transistor Q14 by detecting the base voltage of the series regulating transistor Q11.

The breaker circuit is to detect the base-emitter voltage of the series regulating transistor and to shut down the current that flows from the input terminal into the Zener diode circuit if the resultant detection is not more than a predetermined level.

The transistor Q14 is connected at its emitter to the input terminal 1, the collector thereof is connected to the cathode of the Zener diode of the drop voltage detecting circuit and the base thereof is connected to the collector of the transistor Q15.

The transistor Q15 is connected at its emitter to the emitter of the series regulating transistor Q11 by way of a resistor R16, the base thereof is connected to the base of the series regulating transistor Q11, and the collector thereof is connected to the base of the transistor Q14. The resistor R16 is provided to correct the voltage difference between base-emitter voltages $V_{BBQ11}$ and $V_{BBQ15}$ of the series regulating transistor Q11 and the transistor Q15, respectively.

Subsequently, the operation of the second embodiment will be described.

Figure 1:
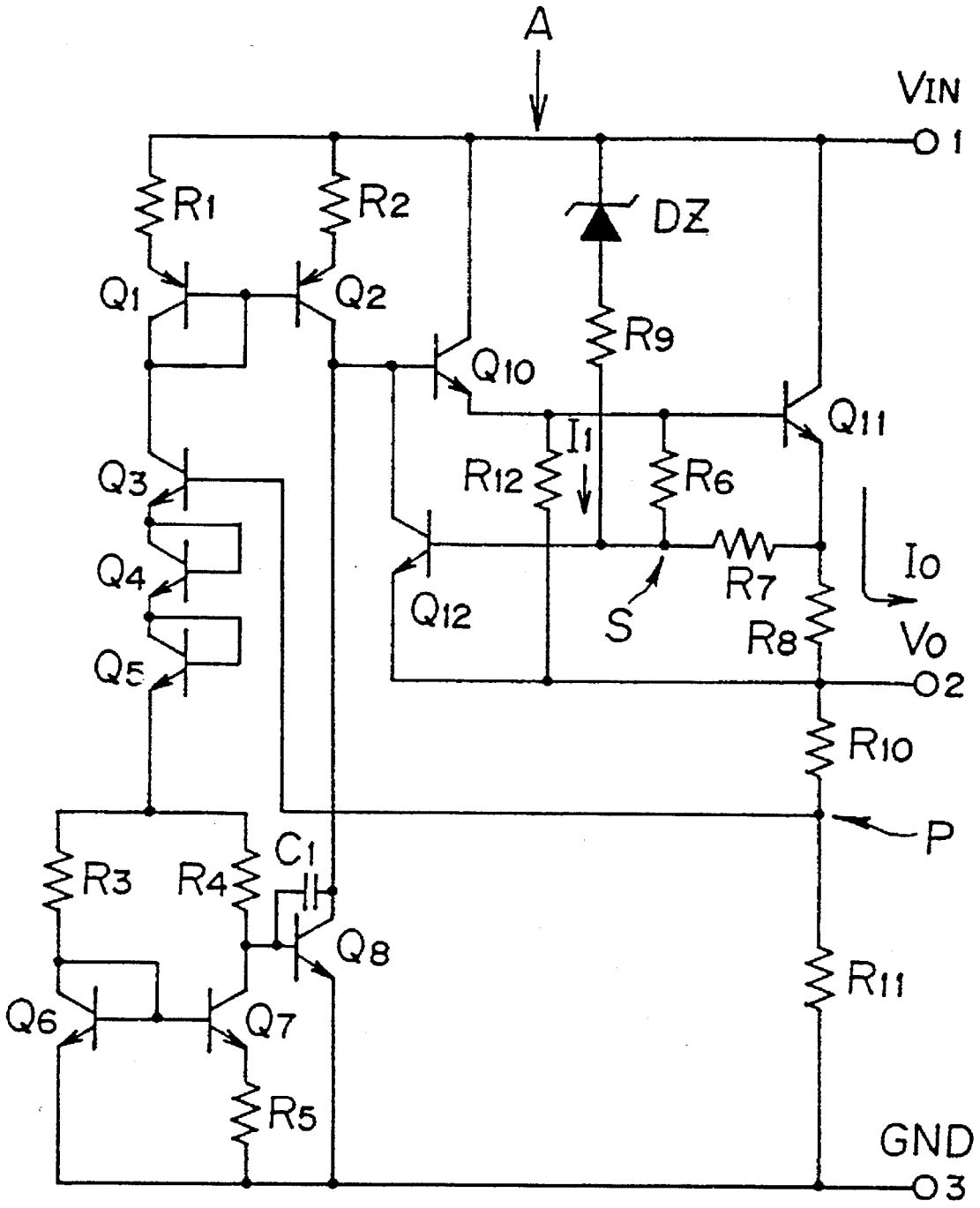
Fig. 1 PRIOR ART
FIG. 1 is a circuit diagram showing a configuration of a prior art three-terminal regulated power supply circuit.
Figure 2:
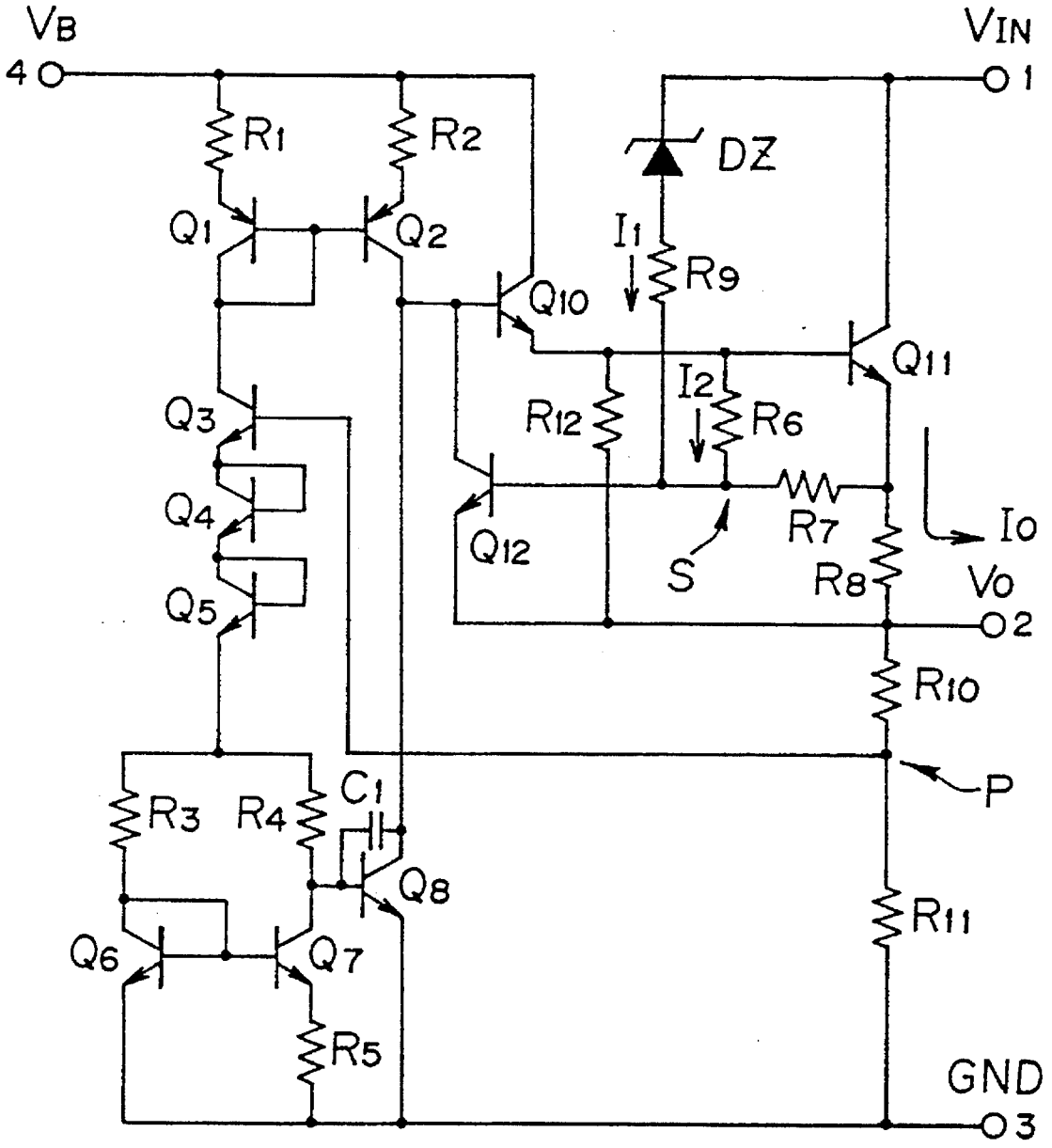
Fig. 2 PRIOR ART
FIG. 2 is a circuit diagram showing a configuration of a prior art bias terminal-equipped regulated power supply circuit.
Figure 3:
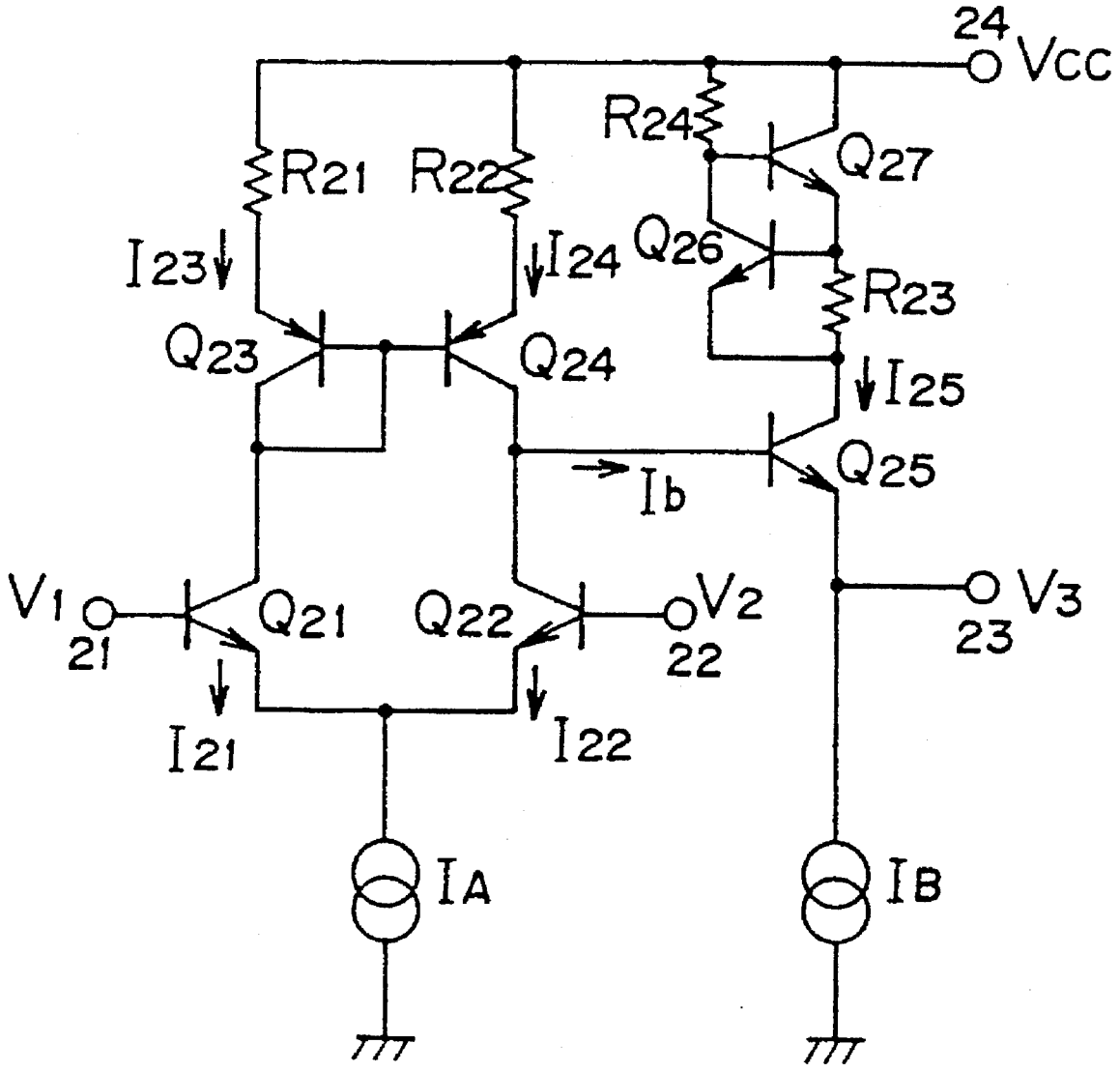
Fig. 3 PRIOR ART
FIG. 3 is a circuit diagram showing a configuration of an amplifying circuit including a prior art emitter follower output current limiting circuit.

Initially, in a case where the output current $I_O$ is outputted, the series regulating transistor Q11 stays in on-state, and the base-emitter voltage $V_{BBQ11}$ is raised or kept over a threshold level thereof. The transistor Q15 is turned on so that the voltage across the resistor R15 exceeds a threshold voltage between the base and emitter of the transistor Q14. Therefore, the transistor Q14 is also turned on. As a result, the drop voltage detecting circuit is formed by a connecting route from the input terminal 1 through the transistor Q14, zener diode DZ and resistor R9 to the base of the transistor Q12. The circuit joining is equivalent to that of the conventional circuit shown in FIG. 2.

By representing a peak output current at the situation as $I_{OP}$, the following relation can be obtained from Eq.(7) above.

$$V_{BBQ12}=V_{BBQ11}\times\{R_7/(R_6+R_7)\}+I_{OP}\times R_8 \tag{16}$$

Suppose that, for instance, $V_{BBQ12}$= $V_{BBQ11}$=0.7V, R6=600Ω, R7=400Ω and R8=0.2Ω, $I_{OP}$ is equal to 2.1A.

When, with the peak output current $I_{OP}$, the output terminal is short-circuited or the load becomes heavier, the output voltage $V_O$ from the output terminal 2 is lowered so that the voltage drop across the series regulating transistor Q11, the emitter-collector voltage $V_{CBQ11}$ increases and thus the power consumption in the regulated power supply circuit increases as follows, if there is no power consumption limiting circuit.

That is, with the representation of the input voltage to the input terminal as $V_{IN}$, the collector-emitter voltage $V_{CBQ11}$ of the series regulating transistor Q11 can be expressed by Eq.(17) as follows:

$$V_{CBQ11}=V_{IN}-V_O-I_{OP}\times R_8 \quad (17)$$

The power consumption $P_{Q11}$ of the series regulating transistor Q11 is given as follows:

$$P_{Q11}\approx V_{CBQ11}\times I_{OP}=(V_{IN}-V_O-I_{OP}\times R_5)\times I_{OP} \quad (18)$$

If power consumption in the other circuitry is neglected, the power consumption $P_C$ as a whole device is given as follows:

$$P_C\approx(V_{IN}-V_0)\times I_{OF} \quad (19)$$

This means that lowering of the output voltage $V_O$ increases the power consumption inside the regulated power supply circuit. For instance, when $V_{IN-VO}$=20V, then $P_C$=40W.

When the potential difference ($V_{IN}-V_O$) between the input and output terminals increases to exceed the Zener voltage $V_{DZ}$ of the Zener diode DZ, current flows from the input terminal 1 to the resistor junction S by way of the resistor R9. This lowers the output peak current $I_{OP}$ to thereby limit the power consumption $P_{Q11}$ and therefore the power consumption $P_C$ of the whole device.

Now, the embodiment will be analyzed numerically.

$$V_{IN}-V_O=I_{OP2}\times R_8+(I_1+I_2)\times R_7+I_1\times R_9+V_{DZ} \quad (20)$$

$$V_{BBQ11}=I_2\times R_6+(I_1+I_2)\times R_7 \quad (21)$$

$$V_{BBQ12}=I_{OP2}\times R_8+(I_1+I_2)\times R_7 \quad (22)$$

Here, $I_{OP2}$ indicates an output peak current value during the power consumption limiting function works. $R_6$, $R_7$, $R_8$ and $R_9$ denote resistance values of resistors R6, R7, R8 and R9, respectively. $I_1$ and $I_2$ denote current values flowing through the Zener diode DZ and resistor R6, respectively.

From Eqs.(20) and (21), the following relation is obtained:

$$V_{IN}-V_O=I_{OP2}\times R_8+I_1\ (R_7+R_9)+\{R_7/(R_6+R_7)\}\times(V_{BBQ11}-R_7\times I_1) \quad (23)$$

For simplicity, it is assumed that $I_1$ is represented approximately as follows.

$$I_1\approx(V_{IN}-V_O-V_{ZD})/R_9 \quad (24)$$

and when, as above, $V_{IN}-V_O\approx$20V, $V_{DZ}$=8V, $R_6$=600Ω, $R_7$=400Ω, $R_8$=0.2Ω and $R_9$=15Ω, then $I_{OP2}\approx$0.82A. At the time, the power consumption $P_{O2}$ in the regulated power supply circuit is inhibited to about 16.4W ($P_{O2}\approx$16.4W). That is, the operation of the current limiting circuit allows the power consumption of the regulated power supply circuit to reduce to about 41%.

Next, description will be made of a case where no output current $I_O$ is outputted or no load is imposed on the output. Current $I_{11}\{I_{11}=V_O/(R_{10}+R_{11})\}$ flowing through the resistor R11 flows resistors R6, R7 and R16. Here, resistance values of the resistors R6, R7 and R16 are selected so as not to cause the base-emitter voltage $V_{BBQ11}$ of the series regulating transistor Q11 to exceed its threshold. Hence, the $V_{BBQ11}$ will not rise and therefore, the transistor Q15 as well as the transistor Q11 is in off-state, which in turn makes the transistor Q14 off. As a result, the drop voltage detecting circuit is shut down.

In this state, if a bias voltage $V_B$ to be applied to a bias input terminal 4 is set as low as zero volt or thereabout, or if the bias input terminal 4 is open, the transistor Q10 can receive no current at its base from the transistor Q2 therefore the transistors Q10 and Q11 stay in off-state. Accordingly, since no current passage will be formed from the input voltage $V_{IN}$ or from the bias voltage $V_B$, no leak current flows and consequently no output voltage $V_O$ will not be outputted at the output terminal 2.

As has been described heretofore, the regulated power supply circuit of the present invention includes the transistor Q14 for turning on and off the drop voltage detecting circuit as a breaker circuit and the transistor Q15 for turning on the transistor Q14 only when the output current flows. In this arrangement, when the drop voltage detecting circuit detects that the voltage drop across the series regulating transistor exceeds the predetermined value, the output current limiting circuit is operated to reduce the power consumption in the series regulating transistor to thereby protect the series regulating transistor from being degraded or broken down. On the other hand, when no output current is outputted, the drop voltage detecting circuit is shut down. Therefore, no leak current flows from the input terminal to the ground terminal, thus presenting an advantage that the power loss can be reduced.

Figure 6:
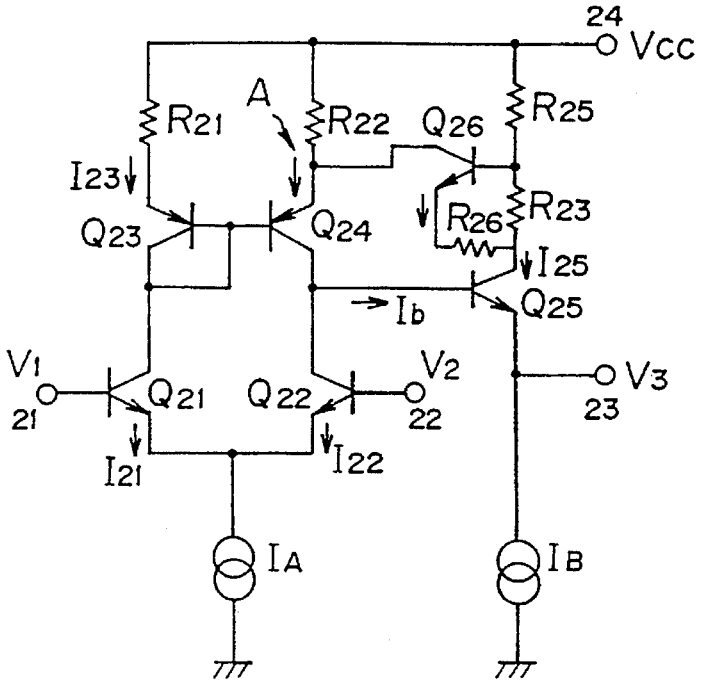
FIG. 6 is a circuit diagram showing a configuration of an amplifying circuit including an emitter follower output current limiting circuit in accordance with a third embodiment of the present invention.

FIG. 6 is a circuit diagram showing an amplifying circuit provided with an emitter follower output current limiting circuit in accordance with a third embodiment of the present invention. Here, the same parts or components with those in the prior art will be assigned with the same reference numerals.

Referring to FIG. 6, the amplifying circuit of the embodiment includes: a differential amplifier consisting of transistors Q21 to Q24 and resistors R21, R22 and a constant-current circuit IA; and an output circuit consisting of an output transistor Q25, a transistor Q26, resistors R23, R25 and a constant-current circuit IB. Here, transistors Q25, Q26 and resistors R23, R25 constitute an output current limiting circuit. Reference numerals 21 and 22 respectively designate input terminals to which differential input signals are input. Reference numerals 23 and 24 designate an output terminal and a power input terminal to which a power voltage $V_{CC}$ is supplied.

In FIG. 6, the transistors Q21 and Q22, which are both connected at their emitters to the common current source IA, are provided from their bases with differential input signals $V_1$ and $V_2$, respectively. On the collector side of the transistors Q21, Q22 is connected a current mirror formation as an active load which comprises the transistors Q23 and Q24 and resistors R21 and R22 and in response to the voltage difference between the input signals $V_1$ and $V_2$, collector voltage of the transistor Q22 varies. The collector voltage of the transistor Q22 is impedance-transformed by the emitter follower of the transistor Q25 to thereby provide an output voltage $V_3$.

The collector of the transistor Q25 is connected to the power supply $V_{CC}$ by way of the current detecting resistor R23 and resistor R25. The base of the output current limiting transistor Q26 is connected with one end of the resistor R23, the other end of which is connected by way of the series resistor R26 with the emitter of the same transistor Q26. The collector of the transistor Q26 is connected to the emitter of the transistor Q24.

If some obstacle causes the output terminal to be short-circuited with a low potential so to urge the emitter current through the transistor Q25 to flow excessively, the voltage drop across the current detecting resistor R23 that is connected to the collector of the transistor Q25 becomes great so that the transistor Q26 is activated. At the time, since collector current $I_{26}$ of the transistor Q26 flows through the resistor R22 from the power supply $V_{CC}$, the voltage drop across the resistor R22 increases. As a result, a current $I_{25}$ will be limited by conditions defined by the following equations (25) to (28).

$$V_{BBQ13}+R_{21}\times I_{23}=V_{BBQ24}+R_{22}\times(I_{24}+I_{26}) \quad (25)$$

$$I_{24}=I_{22}+I_b \quad (26)$$

$$I_{25}=h_{PE}\times I_b \quad (27)$$

$$V_{BBW26}+R_{26}\times I_{26}=R_{23}\times I_{25} \quad (28)$$

A high-level voltage $V_{3H}$ of the output voltage is limited by Eq. (29) or Eq. (30).

$$V_{3H}=V_{OC}-(V_{CBQ25}+V_{R26}+V_{BBQ26}+V_{R25}) \quad (29)$$

$$V_{3H}=V_{OC}-(V_{BBQ25}+V_{CBQ24}+V_{R32}) \quad (30)$$

Now, if it is assumed that $V_{CBQ25}=V_{CBQ25}\approx 0.2V$, $V_{BBQ25}=V_{BBQ26}\approx 0.7V$, $V_{R22}\approx 0.2V$, $V_{R25}\approx 0.1V$ and $V_{R26}=0.1V$, then $V_{3H}=V_{CC}-1.1V$. That is, the circuit configuration of the embodiment enables the output voltage $V_3$ to take a higher value than the prior art configuration.

Figure 7:
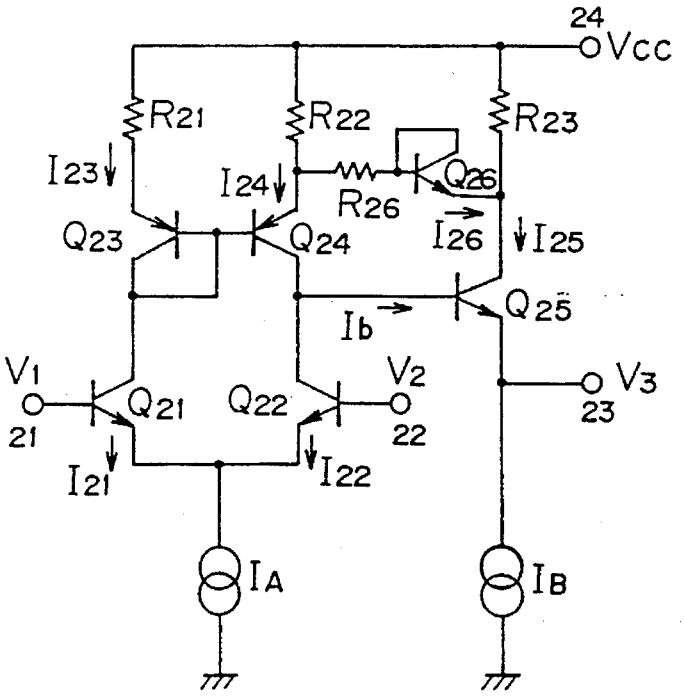
FIG. 7 is a circuit diagram showing a configuration of an amplifying circuit including an emitter follower output current limiting circuit in accordance with a fourth embodiment of the present invention.

Next, FIG. 7 shows a circuit diagram of a differential amplifying circuit provided with an emitter follower output current limiting circuit of a fourth embodiment of the present invention. Here, the same circuit components with those in the third embodiment are assigned with the same reference numerals. In the circuit configuration of the third embodiment, if potential at a point A is greatly lowered by some reason, a forward-bias is applied between the base and collector of the transistor Q26, therefore it is impossible to stably limit the output current. The fourth embodiment is improved in this respect.

A current limiting circuit of the embodiment is constructed by modifying the arrangement of the transistor Q26, resistors R23, R25 and R26 in the circuit of the third embodiment. Specifically, one end of a resistor R26 is connected to a junction between the resistor R22 and the emitter of the transistor Q24 as a load for the differential amplifier and the other end of the resistor R26 is connected to the collector and base of a transistor Q26. The emitter of the transistor Q26 is connected to a junction between the collector of the transistor Q25 and one end of the resistor R23, which is connected at the other end to the power supply $V_{CC}$.

Collector current $I_{25}$ of the transistor Q25 is limited by conditions defined by the following equations (31) to (34).

$$V_{BBQ23}+R_{21}\times I_{23}=V_{BBQ24}+R_{22}\times(I_{24}+I_{26}) \quad (31)$$

$$I_{24}=I_{22}+I_b \quad (32)$$

$$I_{25}=h_{PE}\times I_b \quad (33)$$

$$V_{BBQ26}+I_{26}\times R_{26}+R_{22}\times(I_{24}+I_{26})=R_{23}\times I_{25} \quad (34)$$

A high-level voltage $V_{3H}$ of the output voltage is limited by Eq.(35).

$$V_{3H}=V_{OC}-(V_{CBQ25}+V_{BBQ26}+V_{R22}) \quad (35)$$

Now, if it is assumed that $V_{CBQ25}\approx 0.2V$, $V_{BBQ26}\approx 0.7V$, $V_{R22}\approx 0.2V$, $V_{R21}\approx 0.1V$, then $V_{3H}=V_{CC}-1.2V$. The circuit configuration of this embodiment may also provide an increased high-level output voltage.

As has been described heretofore, according to the present invention, an emitter follower output current limiting circuit with a less voltage drop can be realized. This configuration may provide an increased high-level output voltage using an identical power supply voltage, as compared to that in the conventional configuration. Application of the emitter follower output current limiting circuit to a differential amplifier may effectively provide an amplifier having a wider dynamic range than that of the conventional configuration.

What is claimed is:

1. A regulated power supply circuit comprising:

a series regulating transistor disposed between input and output terminals with the collector and emitter connected to the input and output terminals, respectively;

a reference voltage generating circuit for generating a reference voltage based on a bias voltage that is separately input;

an output voltage detecting circuit for detecting an output-proportional voltage that is proportional to an output terminal voltage;

an error amplifying circuit for controlling the base current of said series regulating transistor on the basis of the detected output-proportional voltage and the reference voltage;

a drop voltage detecting circuit for detecting a voltage between the input and output terminal; and a current limiting circuit for detecting the emitter current of the series regulating transistor and for limiting the base current of the series regulating transistor in response to the resultant detection of the emitter current and the resultant detection of the drop voltage, said current limiting circuit comprising a pair of transistors which are connected at their bases with one another and each of emitter of said pair transistor being connected to the output terminal through a respective resistor.

2. A regulated power supply circuit comprising:

a series regulating transistor disposed between input and output terminals with the collector and emitter connected to the input and output terminals, respectively;

a reference voltage generating circuit for generating a reference voltage based on a bias voltage that is separately input;

an output voltage detecting circuit for detecting an output-proportional voltage that is proportional to an output terminal voltage;

an error amplifying circuit for controlling the base current of said series regulating transistor on the basis of the detected output-proportional voltage and the reference voltage;

a drop voltage detecting circuit for detecting a voltage between the input and output terminal;

a current limiting circuit for detecting the emitter current of the series regulating transistor and for limiting the base current of the series regulating transistor in response to the resultant detection of the emitter current and the resultant detection of the drop voltage; and a breaker circuit which detects a voltage at the base of said series regulating transistor and which, when the resultant detection of the base voltage is not more than a reference setup level, shuts down leak current that flows from the input terminal into said drop voltage detecting circuit.

3. An emitter follower current limiting circuit comprising:

an output transistor disposed in emitter follower arrangement;

a driver transistor having an opposite conduction type to that of said output transistor and being connected at the collector thereof with the base of said output transistor;

collector current detecting means inserted between the collector of said output transistor and a power supply for detecting the collector current of said output transistor; and a feed-back circuit for provide a feed back from the collector of said output transistor to the emitter of said driver transistor.

4. An emitter follower current limiting circuit according to claim 3 wherein said feed-back circuit comprises a transistor, and a voltage between both terminals of said collector current detecting means is connected between the base and emitter of said transistor in said feed-back circuit while the collector of said transistor is connected to the emitter of said driver transistor.

5. An emitter follower current limiting circuit according to claim 3 wherein said feed-back circuit comprises a serially connected circuit of a diode and a resistor.

* * * * *